US009335735B2

(12) United States Patent
Kayama et al.

(10) Patent No.: US 9,335,735 B2
(45) Date of Patent: May 10, 2016

(54) IMAGE FORMING APPARATUS HAVING ARRANGEMENT FOR EFFICIENT DISCHARGE OF GENERATED WATER VAPOR

(71) Applicant: CANON KABUSHIKI KAISHA, Tokyo (JP)

(72) Inventors: Naonori Kayama, Yokohama (JP); Ryosuke Takahashi, Kawasaki (JP); Yuuma Hada, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/606,564

(22) Filed: Jan. 27, 2015

(65) Prior Publication Data

US 2015/0212484 A1 Jul. 30, 2015

(30) Foreign Application Priority Data

Jan. 27, 2014 (JP) ..... 2014-012427

(51) Int. Cl.

| | |
|---|---|
| ***G03G 21/20*** | (2006.01) |
| ***G03G 15/00*** | (2006.01) |
| ***G03G 21/16*** | (2006.01) |

(52) U.S. Cl.

CPC ..... *G03G 21/206* (2013.01); *G03G 15/60* (2013.01); *G03G 21/1604* (2013.01); *G03G 21/203* (2013.01)

(58) Field of Classification Search

USPC ..... 399/91–97, 107, 110, 125

See application file for complete search history.

(56) References Cited

U.S. PATENT DOCUMENTS

| | | | | |
|---|---|---|---|---|
| 6,501,922 | B2 * | 12/2002 | Ihara et al. | 399/92 |
| 7,603,051 | B2 | 10/2009 | Kasai | |
| 2006/0257161 | A1 * | 11/2006 | Adachi et al. | 399/92 |
| 2009/0238608 | A1 * | 9/2009 | Murase et al. | 399/262 |

FOREIGN PATENT DOCUMENTS

| | | | |
|---|---|---|---|
| JP | 2002-171372 | A | 6/2002 |
| JP | 2007-147834 | A | 6/2007 |
| JP | 2007-156418 | A | 6/2007 |
| JP | 2008-281699 | A | 11/2008 |

* cited by examiner

*Primary Examiner* — Hoan Tran

(74) *Attorney, Agent, or Firm* — Fitzpatrick, Cella, Harper & Scinto

(57) ABSTRACT

An image forming apparatus includes an image forming station including a heater for heating a sheet and a discharge opening for discharging the sheet having passed through the heater in a discharging direction; an image reading station provided above the image forming station to read image information of an original; and a duct portion provided by an upper surface of the image forming station and a lower surface of the image reading station, and at a position upstream of the discharge opening with respect to the discharging direction; A portion of the lower surface of the image reading station as provides the duct portion is at a level higher toward an upstream side with respect to the discharging direction.

15 Claims, 13 Drawing Sheets

IMAGE FORMING APPARATUS HAVING ARRANGEMENT FOR EFFICIENT DISCHARGE OF GENERATED WATER VAPOR

FIELD OF THE INVENTION AND RELATED ART

The present invention relates to an image forming apparatus such as a copying machine, a printer, a facsimile machine, and the like.

Some conventional image forming apparatuses are provided with an original reading device (original reading section), which is on the main assembly of the image forming apparatus. In the case of this type of image forming apparatus, the water vapor generated in the main assembly of the image forming apparatus is discharged through its sheet discharge opening, and/or water vapor comes out of the discharged sheets. Thus, it is possible that this water vapor will fill up the space between the main assembly and original reading device of the image forming apparatus, and condense into droplets of water on the bottom surface of the original reading device. These droplets of water possibly adhere to sheets as the sheets are discharged through the above-described space. If the original reading device is positioned as high as it is in the case of the image forming apparatus disclosed in Japanese Laid-open Patent Application 2008-281699, this condensation of water vapor is less likely to occur.

However, positioning an original reading device as high as it is in the case of the image forming apparatus disclosed in Japanese Laid-open Patent Application 2008-281699 increases an image forming apparatus in size.

SUMMARY OF THE INVENTION

Thus, the primary object of the present invention is to provide an image forming apparatus which is capable of efficiently discharging water vapor from the space between its image formation section and original reading section, and yet, is no greater in size than an image forming apparatus in accordance with the prior art.

According to an aspect of the present invention, there is provided an image forming apparatus comprising an image forming station including a heating portion for heating a sheet and a discharge opening for discharging a sheet having passed through said heating portion, in a discharging direction; an image reading station provided above said image forming station to read image information of an original; and a duct portion provided by an upper surface of said image forming station and a lower surface of said image reading station, at a position upstream of said discharge opening with respect to the discharging direction, wherein such a portion of said lower surface of said image reading station as provides said duct portion is at a level higher toward an upstream with respect to the discharging direction.

According to another aspect of the present invention, there is provided an image forming apparatus comprising an image forming station including a heating portion for heating a sheet and a sheet stacking portion for stacking the sheet discharged through said heating portion in a discharging direction, said sheet stacking portion being provided in an upper portion of said image forming apparatus; an image reading station provided above said image forming station to read image information of an original; and a duct portion provided by an upper surface of said image forming station and a lower surface of said image reading station, and a position upstream of said stacking portion with respect to the discharging direction, wherein such a portion of said lower surface of said image reading station as provides said duct portion is at a level higher toward an upstream with respect to the discharging direction.

Further features of the present invention will become apparent from the following description of exemplary embodiments with reference to the attached drawings.

DESCRIPTION OF THE PREFERRED EMBODIMENTS

Embodiment 1

Figure 1:
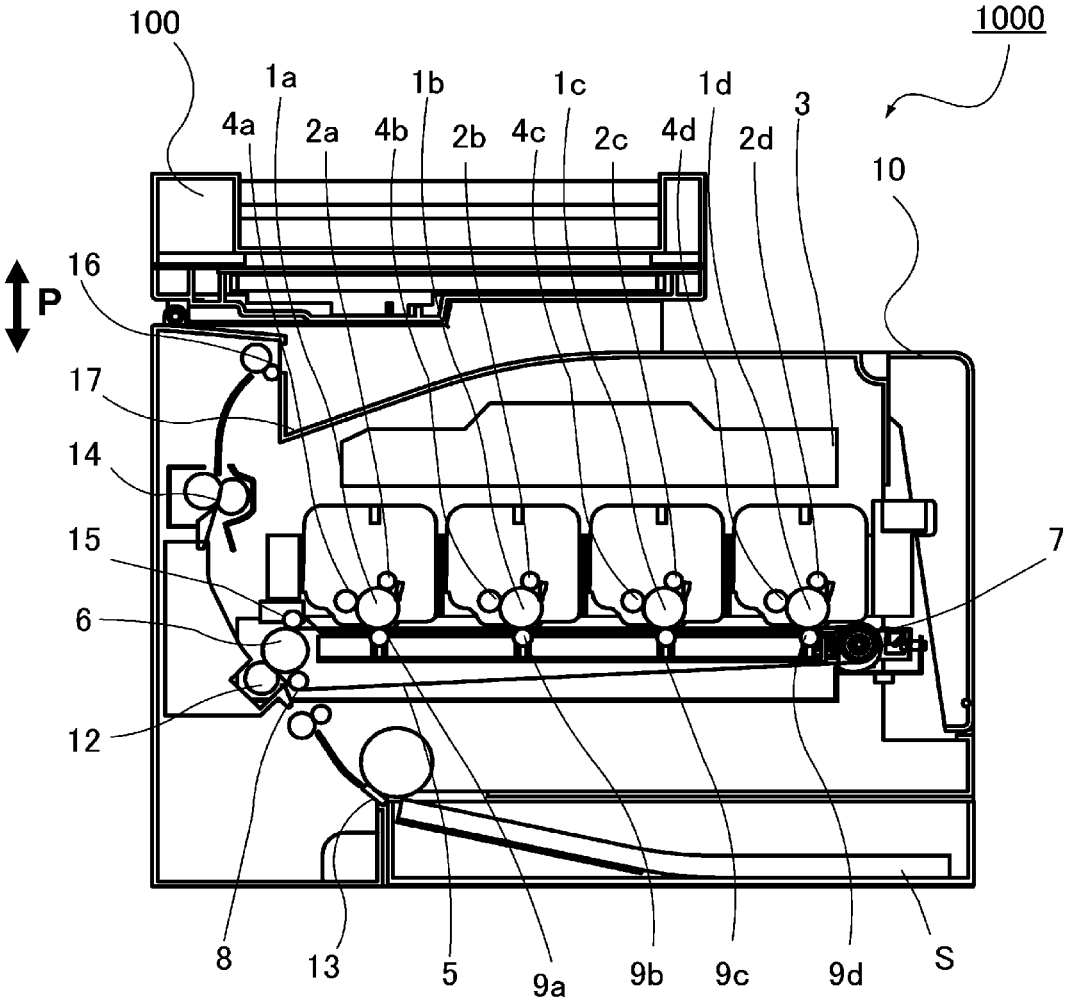
FIG. 1 is a drawing for showing the structure of the image forming apparatus in the first embodiment of the present invention.

Hereinafter, a few of the preferred embodiments of the present invention are described with reference to appended drawings. FIG. 1 is a drawing for showing the structure of the image forming apparatus 1000 in the first embodiment of the present invention. Referring to FIG. 1, the image forming apparatus 1000 in this embodiment is provided with an original reading device 100 (original reading section), which is on the top side of the main assembly 10 (image forming section) of the image forming apparatus 1000, in terms of the vertical direction P.

In the apparatus main assembly 10, the photosensitive drums 1*a*-1*d* charged by the charge rollers 2*a*-2*d*, respectively, are exposed to a beam of laser light outputted by the exposing device 3 while being modulated according to the information of the image to be formed. Thus, electrostatic latent images are formed on the photosensitive drums 1*a*-1*d*, one for one. Then, the four electrostatic latent images are developed by the developing devices 4*a*-4*d* into toner images, one for one, which are different in color. Then, the four toner images, different in color, are sequentially transferred in layers (primary transfer) by the primary transfer rollers 9*a*-9*d*, one for one, onto the intermediary transfer belt 5 which is suspended and kept tensioned by the suspending/tensioning members (driver roller 6, tension roller 7, and idler roller 8).

Meanwhile, the sheets S in the sheet feeding/conveying tray are conveyed one by one by the sheet feeding roller 13 to the nip between the intermediary transfer belt 5 and secondary transfer roller 12, in which the toner images are transferred onto the sheet S (secondary transfer). After the transfer of the toner images onto the sheet S, the sheet S is subjected to heat and pressure by the fixing device 14 (fixing section). Consequently, the toner images become fixed to the sheet S. After being conveyed through the fixing device 14, the sheet S is discharged through the sheet discharge opening 16 into the delivery tray 17 (sheet accumulation surface), which is a part of the top wall of the apparatus main assembly 10.

Figure 2:
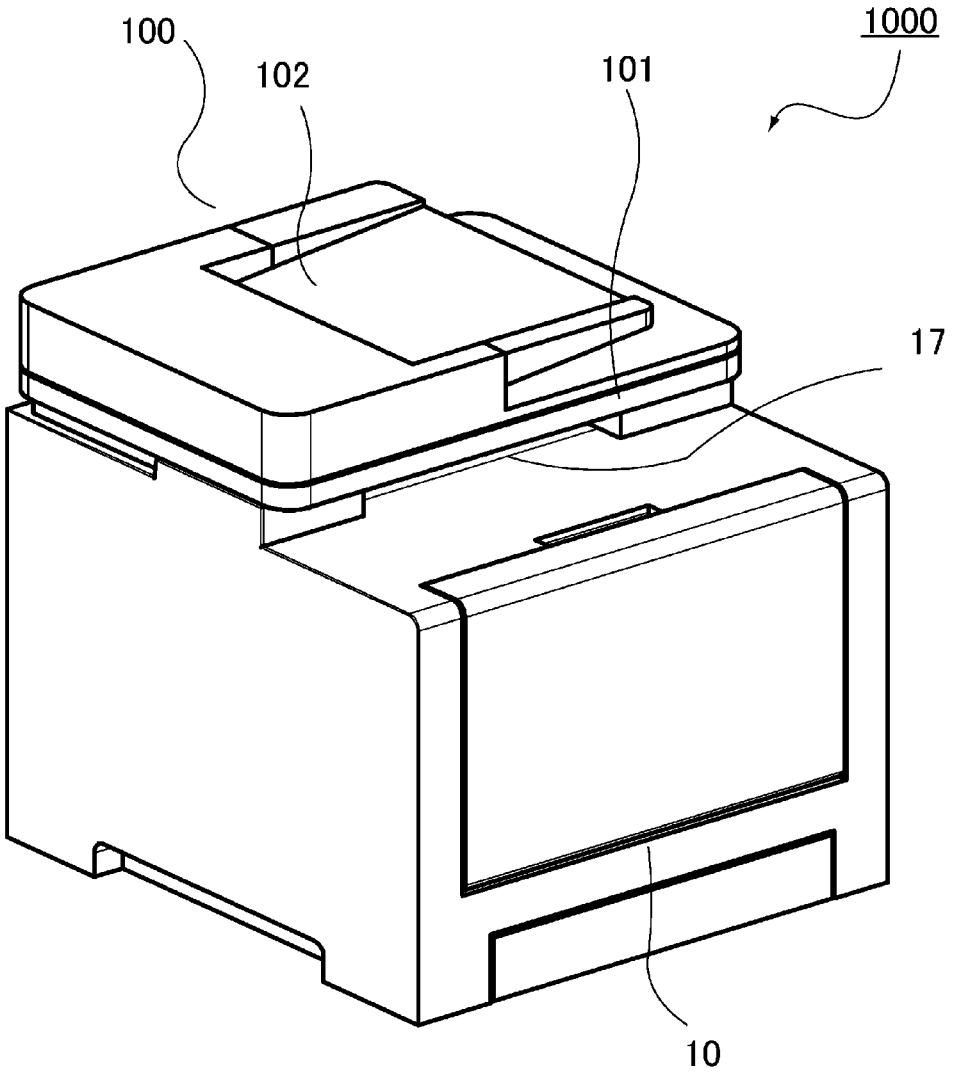
FIG. 2 is a perspective view of the image forming apparatus in the first embodiment.

FIG. 2 is a perspective view of the image forming apparatus 1000 in this embodiment. Referring to FIG. 2, the original reading device 100 is made up of a scanner 101 and an automatic original conveying section 102. As an original is conveyed through the automatic original conveying section 102, it is read by the scanner 101; the information necessary to form a copy of the original is obtained by the original reading device 100. The information of the original obtained by the original reading device is sent to the apparatus main assembly 10.

Figure 3:
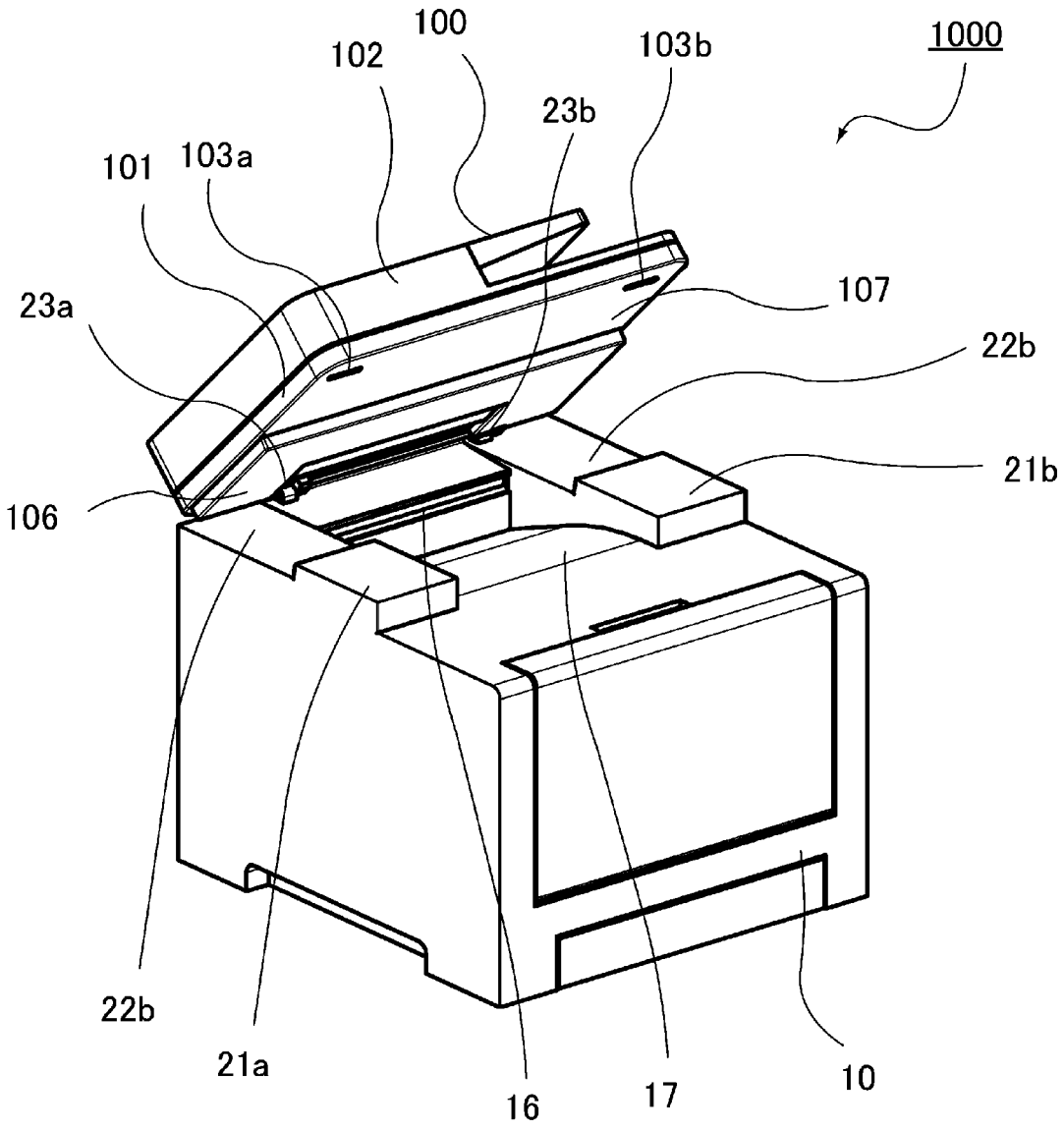
FIG. 3 is a perspective view of the image forming apparatus in the first embodiment when the original reading device is in its upright (open) position relative to the main assembly.

FIG. 3 is a perspective view of a combination of the apparatus main assembly 10 and original reading device 100 when the original reading device 100 is in its upright (open) position relative to the apparatus main assembly 10. Referring to FIG. 3, the original reading device 100 is attached to the apparatus main assembly 10 so that it can be pivotally moved about a pair of hinges 23*a* and 23*b*. The apparatus main assembly 10 is provided with a pair of upwardly facing left and right surfaces 22*a* and 22*b*, which are on the rear side of the apparatus main assembly 10, and a pair of upwardly facing left and right surfaces 21*a* and 21*b*, which are on the front side of the apparatus main assembly 10. The pair of upwardly facing left and right surfaces 21*a* and 21*b* are the surfaces by which the original reading device 100 is supported when the original reading device 100 is in use.

Further, there are provided a pair of protrusions 103*a* and 103*b*, which are on the front-left and front-right sides of the apparatus main assembly 10. When the image forming apparatus 1000 is in use, the original reading device 100 is kept in its horizontal (closed) position (FIG. 2), and the protrusions 103*a* and 103*b* remain in contact with the supporting surfaces 21*a* and 21*b*, respectively. In a case where the sheets discharged into the delivery tray 17 are small, or the discharge opening 16 becomes jammed with a sheet of paper, a user is to pivotally move the original reading device 100 into its upright (open) position.

Figure 4:
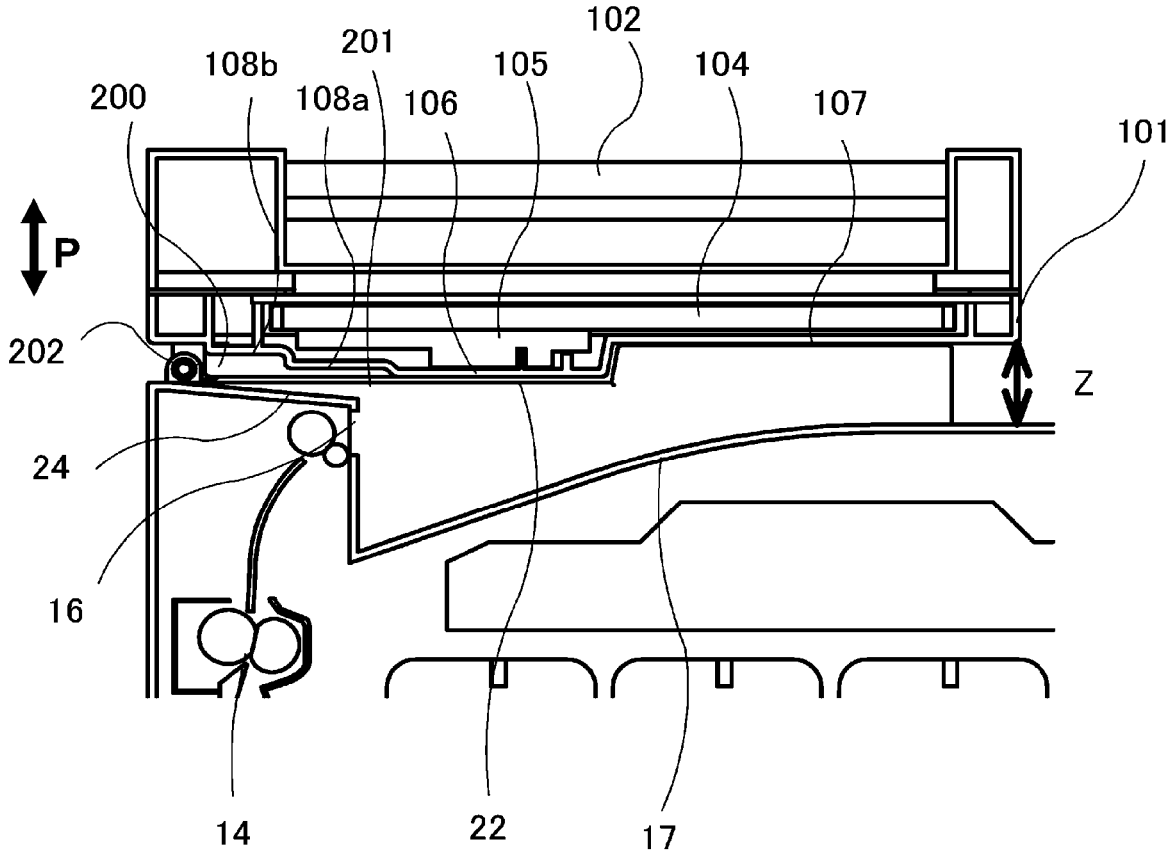
FIG. 4 is a sectional view of the combination of the original reading device and main assembly of the image forming apparatus in the first embodiment, and shows the positional relationship between the original reading device and main assembly.

Referring to FIG. 4, the scanner 101 has a reading sensor 104 and a carriage 105, which are movable in the left-right direction. The bottom side of the scanner 101 is covered with a carriage cover section 106 and a reading sensor cover section 107 of the scanner casing. The carriage covering section 106 covers the carriage track. The reading sensor covering section 107 covers the reading sensor track. The carriage 105 is on the rear end side of the apparatus main assembly 10. Therefore, it is possible to provide a space Z between the front side of the delivery tray 17 and the front side of the reading sensor cover section 107. The presence of this space Z makes it easier for a user to access the sheets S in the delivery tray 17.

Figure 5:
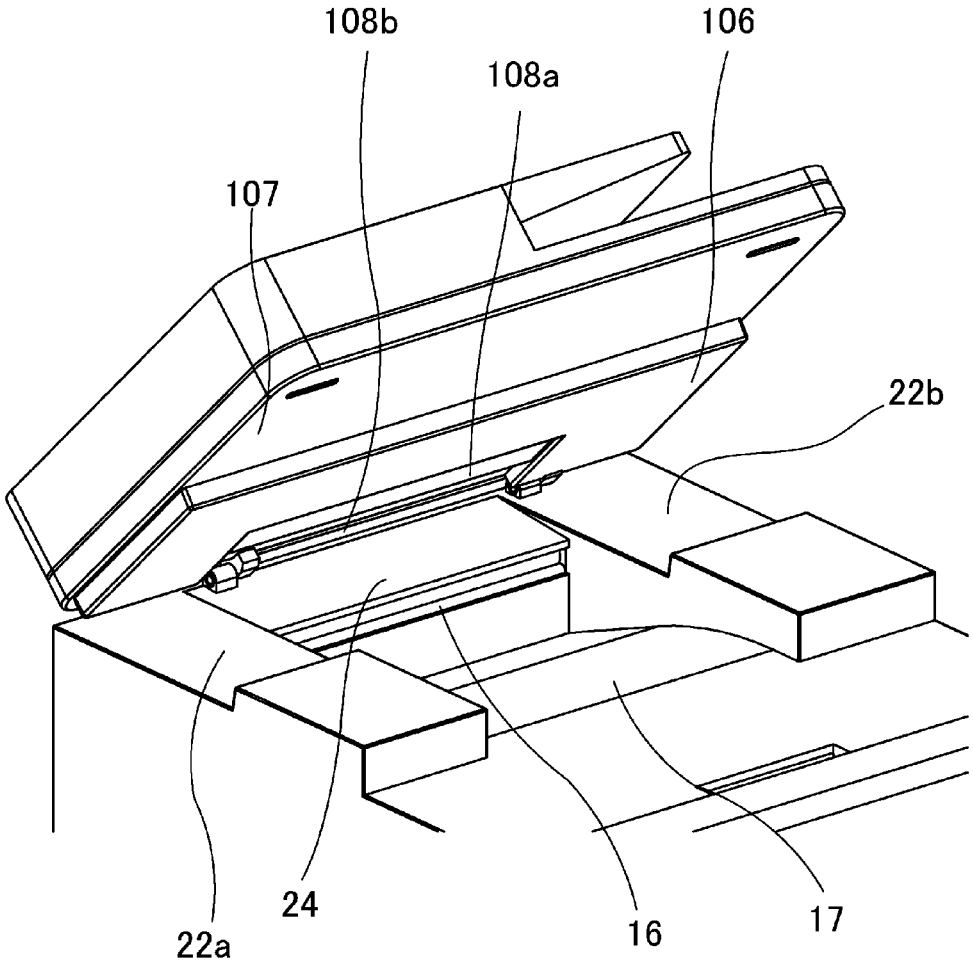
FIG. 5 is a perspective view of the combination of the original reading device and main assembly of the image forming apparatus in the first embodiment, and shows the positional relationship between the original reading device and main assembly when the original reading device is in its upright (open) position.

Referring to FIG. 5, the upwardly facing side of the apparatus main assembly 10 is provided with a slanted surface 24, which covers the rear-center portion of the top side of the apparatus main assembly 10. The slanted surface 24 is between the pair of rear-top surfaces 22*a* and 22*b*. It extends rearward (from downstream side to upstream side, in terms of sheet discharge direction E) from the adjacencies of the sheet discharge opening 16, and is slanted in such a manner that its rear end is higher than its front end in terms of the vertical direction. That is, the rear end portion (downstream end in terms of sheet discharge direction E) of the slanted surface 24 is positioned higher than the front end portion (upstream end in terms of sheet discharge direction E) of the slanted surface 24. The center portion of the carriage cover section 106 is provided with front-center surface 108*a* (first surface), which is on the front side (downstream in terms of sheet discharge direction E), and a rear-center surface (second surface) 108*b*, which is on the rear side (upstream in terms of sheet discharge direction E). The front-center surface 108*a* and rear-center surface 108*b* are positioned so that they oppose the slanted surface 24. The rear-center surface 108*b* is positioned higher than the front-center surface 108*a* in terms of the vertical direction.

Figure 6:
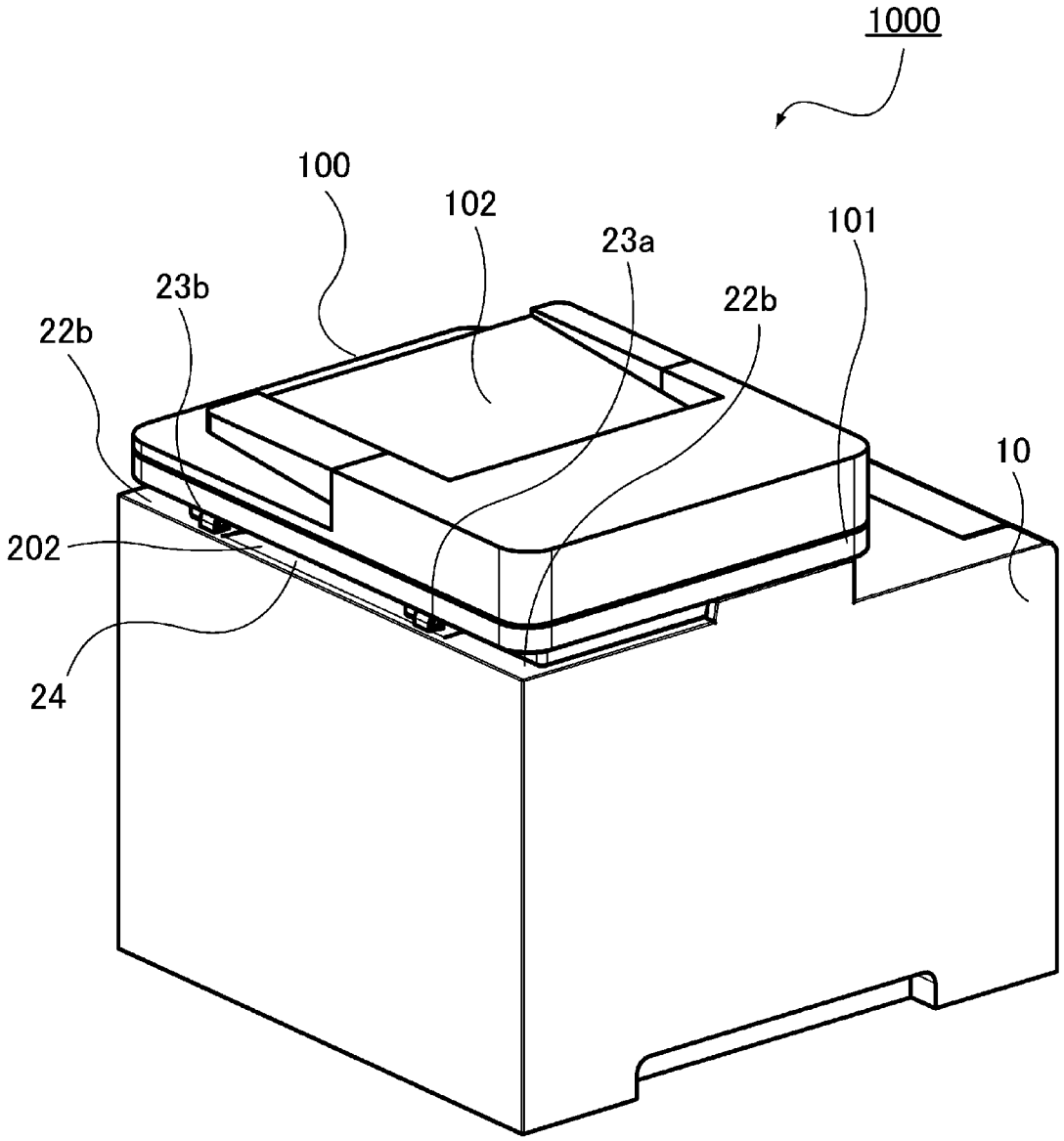
FIG. 6 is a perspective view of the image forming apparatus in the first embodiment as seen from the rear side of the apparatus.

Referring to FIG. 4, a duct 200 (space) is formed by the bottom surface (front-center surface 108*a*, rear-center surface 108*b*) of the original reading device 100, and the top surface (rear-top surfaces 22*a* and 22*b*, and slanted surface 24) of the apparatus main assembly 10. Referring to FIGS. 4 and 6, the duct 200 has the front and rear openings 201 and 202. The front opening 201 is on the front side of the apparatus main assembly 10, and the rear opening 202 is on the rear side of the apparatus main assembly 10. In terms of the vertical direction, the rear opening 202 of the duct 200 is positioned higher than the front opening 201 of the duct 200.

Figure 7:
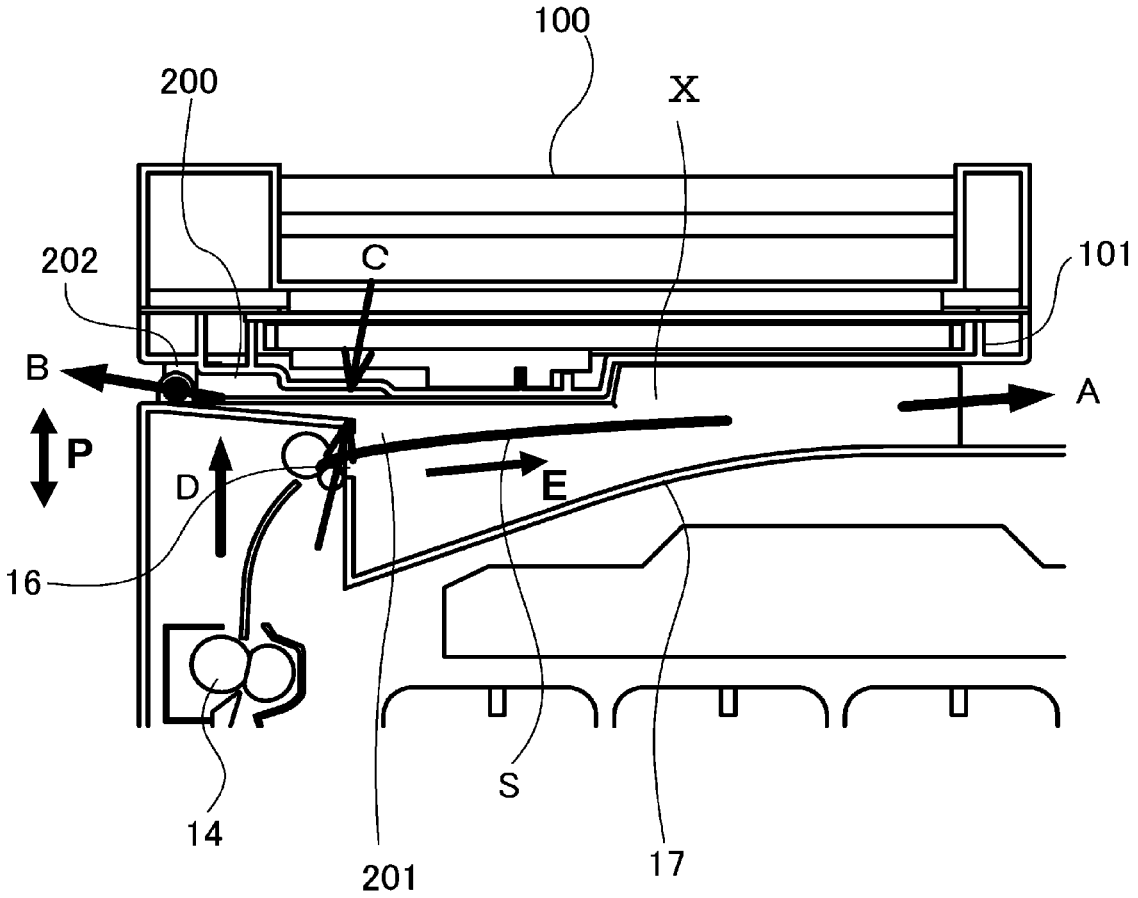
FIG. 7 is a drawing for showing the water vapor discharge passage of the image forming apparatus in the first embodiment.

FIG. 7 is a drawing which shows the water vapor discharge passage of the image forming apparatus 1000 in this embodiment. Referring to FIG. 7, the sheet S is discharged from the sheet discharge opening 16 in the direction indicated by an arrow mark E. Further, as the sheet S is heated by the fixing device 14, the moisture in the sheet S evaporates. The resultant water vapor is discharged out of the fixing device 14 through the sheet discharge opening 16. By the way, even after sheets S are discharged from the apparatus main assembly 10 in a manner to be layered in the delivery tray 17, the moisture in the sheets S is made to evaporate, by the heat remaining in the sheets S.

As the moisture in the sheets S evaporates, the resultant water vapor fills the discharge area X which is between the delivery tray 17 and the bottom surface (carriage cover section 106, reading sensor cover section 107) of the original reading device 100. As the water vapor fills up the discharge area X, a part of the water vapor disperses frontward (downstream, in terms of sheet discharge direction E) of the apparatus main assembly 10 and is discharged out of the apparatus main assembly 10 (direction indicated by arrow mark A).

In terms of the vertical direction, the fixing device 14 is positioned lower than the slanted surface 24. Thus, the heat from the fixing device 14 rises (in direction indicated by an arrow mark D), and warms the slanted surface 24. Thus, the air in the duct 200 is warmed by the heat from the fixing device 14 through the slanted surface 24. As the air in the duct 200 is warmed, it reduces in density, and therefore, rises. As a result, the air moves from the front opening 201 of the duct 200, which is on the upstream side of the sheet discharge opening 16 and delivery tray 17 in terms of the sheet discharging direction E, to the rear opening 202 of the duct 200. Thus, the water vapor in the discharge area X is drawn by this movement of the air, into the duct 200 through the front opening 201 of the duct 200, and is discharged out of the apparatus main assembly 10 through the rear opening 202 of the duct 200 (direction indicated by arrow mark B).

Figure 8:
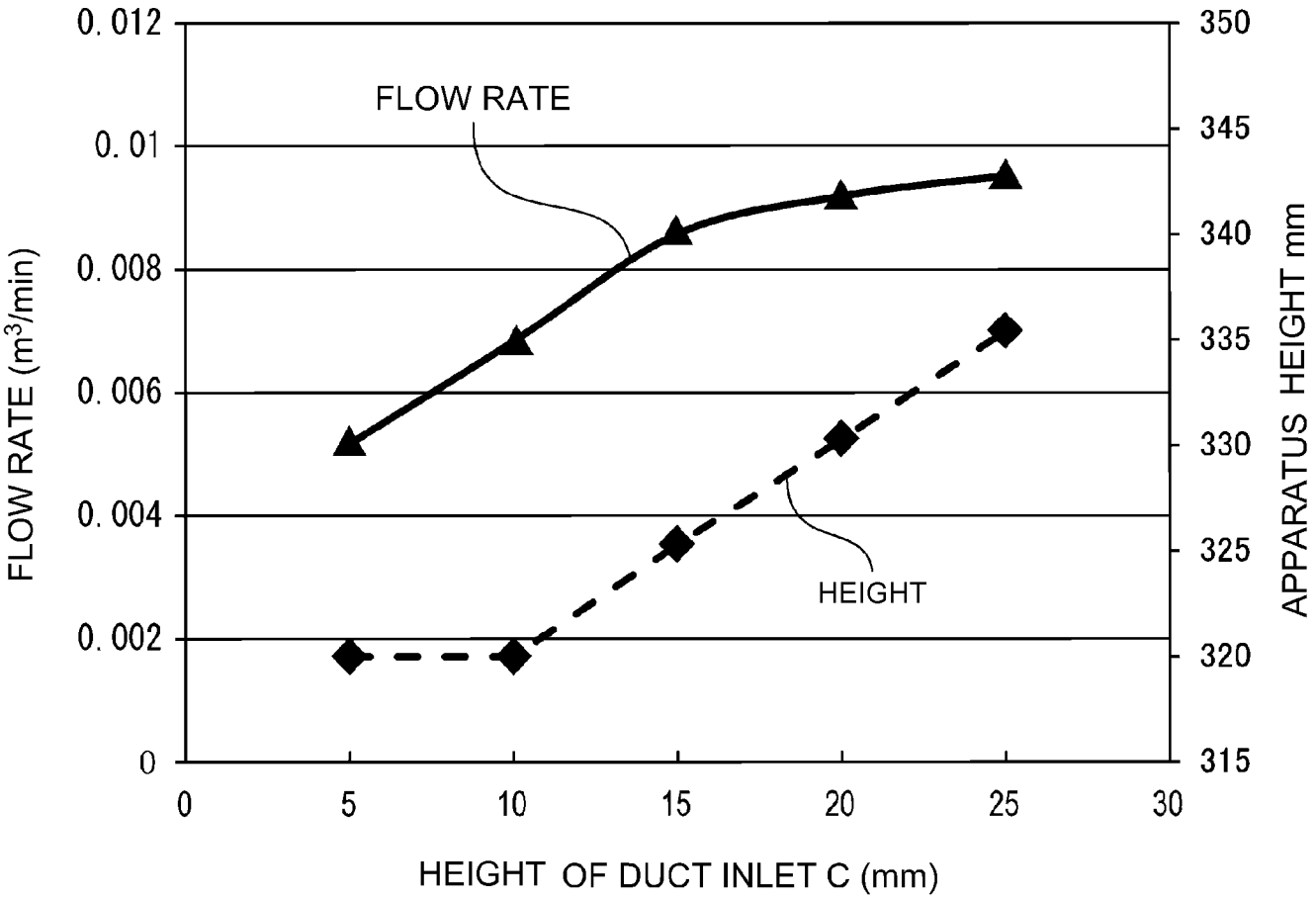
FIG. 8 is a drawing which shows the relationship among the duct entrance height, air flow rate through the duct, calculated with the use of thermal fluid dynamics simulation, and image forming apparatus height, in the first embodiment.

FIG. 8 is a drawing for showing the relationship among the duct entrance height C (height of front opening 201 of duct 200), amount by which air flows into the duct 200, which was calculated by thermal fluid dynamics simulation, and product height (height of image forming apparatus 1000). As is evident from FIG. 8, by setting the duct entrance height C to a value in a range of 5-15 mm, it is possible to reduce the product in height, while ensuring that air flows into the duct 200 by a sufficient amount.

By structuring the image forming apparatus 1000 as described above, not only is it possible to highly efficiently discharge the water vapor, from the front side of the apparatus main assembly 10 (direction indicated by arrow mark A), but also, from the rear side of the apparatus main assembly 10 (direction indicated by arrow mark B). Thus, it is possible to highly efficiently discharge the water vapor in the space between the original reading device 100 and main assembly 10 of the image forming apparatus 1000, from the image forming apparatus 1000, and therefore, to prevent the water vapor from condensing on the bottom surface of the original reading device 100, without increasing the image forming apparatus 1000 in size, and also, altering the image forming apparatus 1000 in frontal appearance. By the way, in this embodiment, natural convection is utilized to discharge the water vapor. However, the water vapor may be forcefully discharged with the use of a fan.

Embodiment 2

Figure 9:
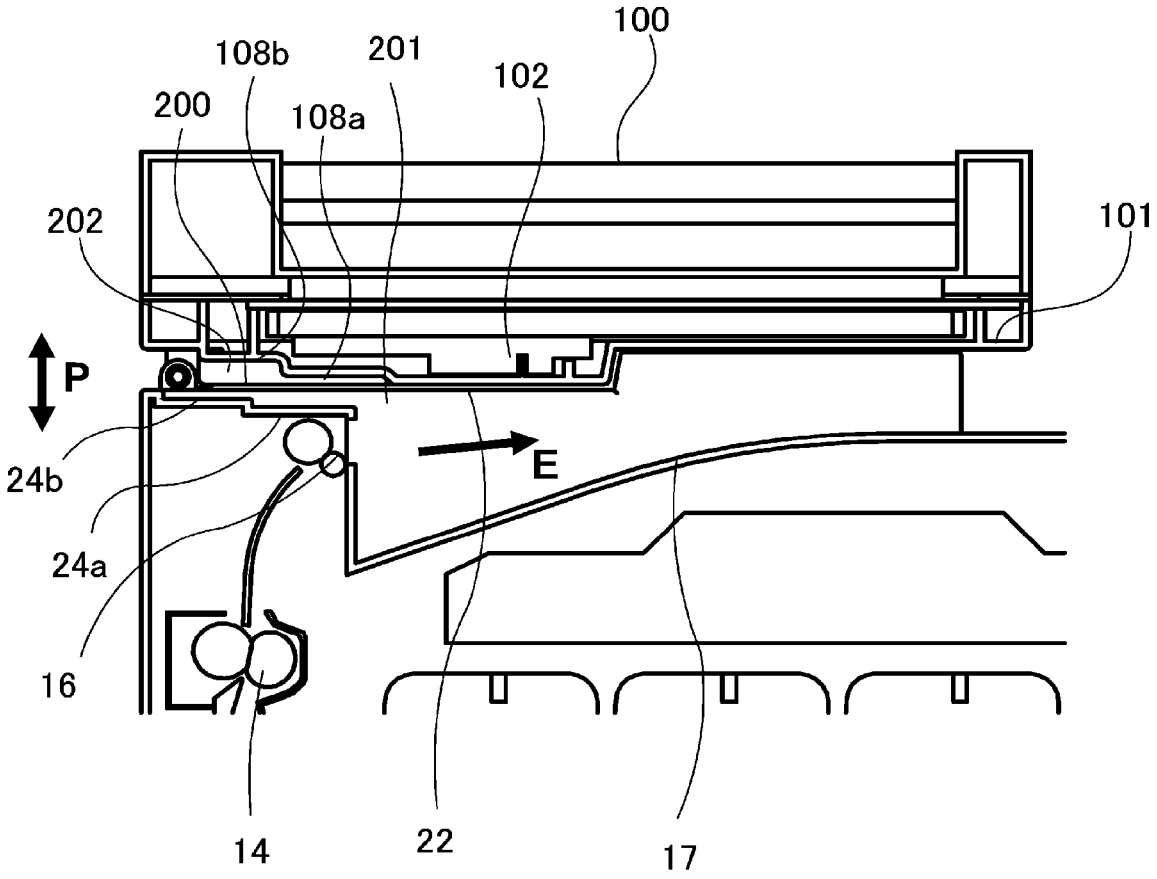
FIG. 9 is a sectional view of a combination of the original reading device and main assembly of the image forming apparatus in the second embodiment of the present invention, and shows the positional relationship between the original reading device and main assembly.

Next, the image forming apparatus 1000 in the second embodiment is described with reference to the appended drawings. The components, parts thereof, etc., of the image forming apparatus in this embodiment, which are the same in description as the counterparts in the first embodiment, are given the same referential codes as those given to the counterparts, and are not described. FIG. 9 is a sectional view of a combination of the original reading device and main assembly of the image forming apparatus in this embodiment. It shows the positional relationship between the original reading device and apparatus main assembly.

Referring to FIG. 9, the image forming apparatus in this embodiment is provided with a front-center surface 24*a* (third surface) and a rear-center surface 24*b* (fourth surface), which replace the slanted surface 24 in the first embodiment. The front-center surface 24*a* and rear-center surface 24*b* make up the center portion of the rear portion of the top surface of the apparatus main assembly 10. That is, the front-center surface 24*a* and rear-center surface 24*b* are sandwiched by the left and right end portions 22*a* and 22*b* of the rear portion of the top surface of the apparatus main assembly 10.

The front-center surface 24*a* is on the front side (downstream in terms of sheet discharge direction E), and the rear-center surface 24*b* is on the rear side (upstream in terms of sheet discharge direction E). The front-center surface 24*a* and rear-center surface 24*b* are positioned so that they directly face the front-center surface 108*a* and rear-center surface 108*b*. In terms of the vertical direction, the rear-center surface 24*b* is positioned higher than the front-center surface 24*a*. The duct 200 is made up of front-center surface 24*a*, rear-center surface 24*b*, front-center surface 108*a*, rear-center surface 108*b*, top-rear surface 22*a*, and top-rear surface 22*b*.

The above-described structural arrangement in this embodiment can also position the rear opening of the duct 200 higher than the front opening 201 of the duct 200, like the structural arrangement in the first embodiment. Thus, it is possible to enable the water vapor discharge passage to discharge the water vapor from the apparatus main assembly 10 not only from the front side of the apparatus (direction indicated by arrow mark A), but also, from the rear side of the apparatus main assembly (direction indicated by arrow mark B). Therefore, it is possible to highly efficiently discharge the water vapor from the space between the original reading device 100 and main assembly 10 of the image forming apparatus 1000, and therefore, to prevent the water vapor from condensing on the bottom surface of the original reading device 100, without increasing the image forming apparatus 1000 in size, and also, altering the apparatus main assembly 10 in frontal appearance.

Embodiment 3

Figure 10:
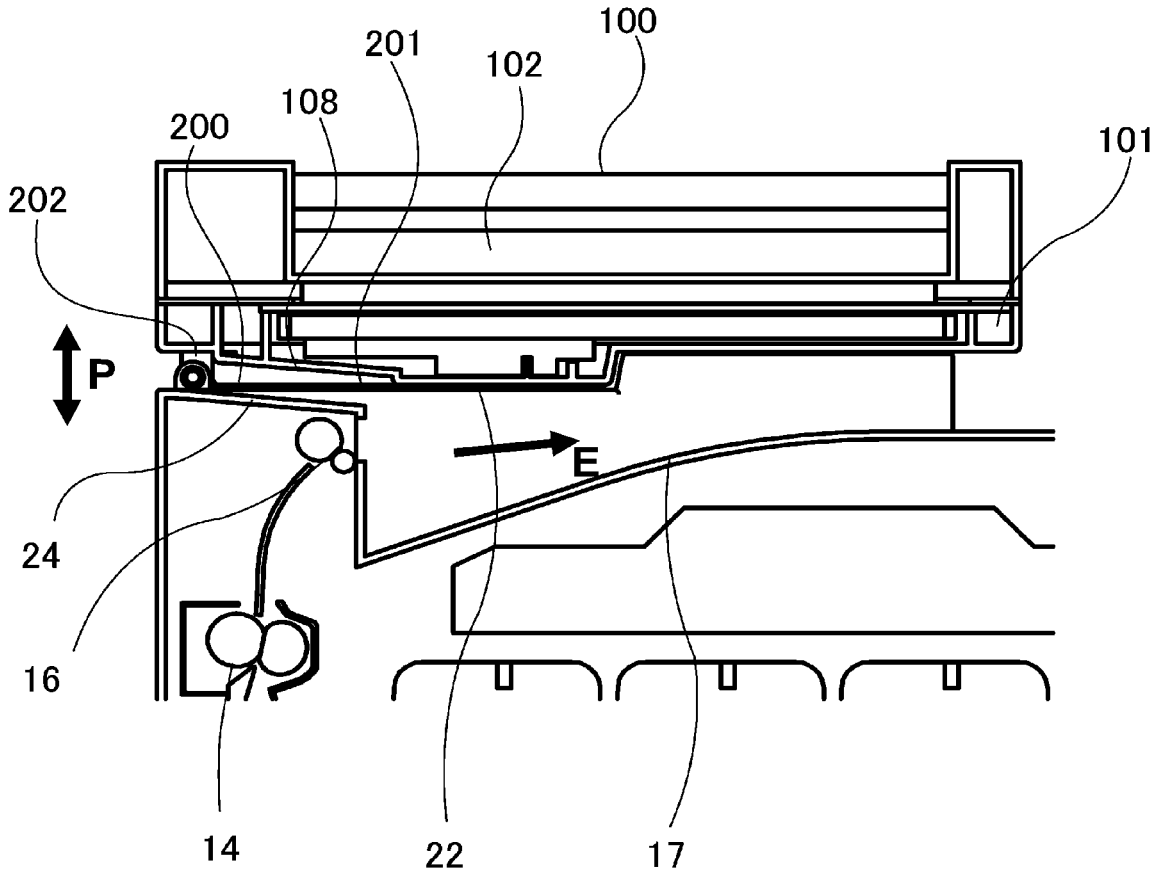
FIG. 10 is a sectional view of a combination of the original reading device and main assembly of the image forming apparatus in the third embodiment of the present invention, and shows the positional relationship between the original reading device and main assembly.

Next, the image forming apparatus in the third embodiment of the present invention is described with reference to the appended drawings. The components, portions thereof, etc., of the image forming apparatus in this embodiment, which are the same in description as the counterparts in the first embodiment, are given the same referential codes as those given to the counterparts, and are not described here. FIG. 10 is a sectional view of the original reading device 100 and main assembly 10 of the image forming apparatus in this embodiment, and shows the positional relationship between the original reading device 100 and apparatus main assembly 10.

Referring to FIG. 10, the image forming apparatus in this embodiment is provided with a slanted surface 108, which replaces the rear-center surfaces 108*a* and 108*b* in the first embodiment. The slanted surface 108 is positioned below the center portion of the carriage cover section 106, and is sandwiched between the rear-top surfaces 22*a* and 22*b*. Further, the slanted surface 108 is positioned so that it directly faces the slanted surface 24. It is slanted so that its front portion, which is in the adjacencies of the sheet discharge opening 16, is positioned lower, in terms of the vertical direction, than its rear portion (upstream portion in terms of sheet discharge direction E). The duct 200 is made up of the slanted surface 24, slanted surface 108, rear-top surface 22*a*, and rear-top surface 22*b*.

The above-described structural arrangement in this embodiment can also position the rear opening of the duct 200 higher, in terms of the vertical direction, than the front opening 201 of the duct 200, like the structural arrangement in the first embodiment. Thus, it is possible to structure the water vapor discharge passage so that the water vapor is discharged not only from the front side of the apparatus main assembly 10 (direction indicated by arrow mark A), but also, from the rear side of the apparatus main assembly 10 (direction indicated by arrow mark B). Therefore, it is possible to highly efficiently discharge the water vapor from the space between the main assembly and original reading device 100 of the image forming apparatus 1000, and therefore, to prevent the water vapor from condensing on the bottom surface of the original reading device 100, without increasing the image forming apparatus 1000 in size, and also, altering in appearance the front side of the image forming apparatus 1000.

Embodiment 4

Figure 11:
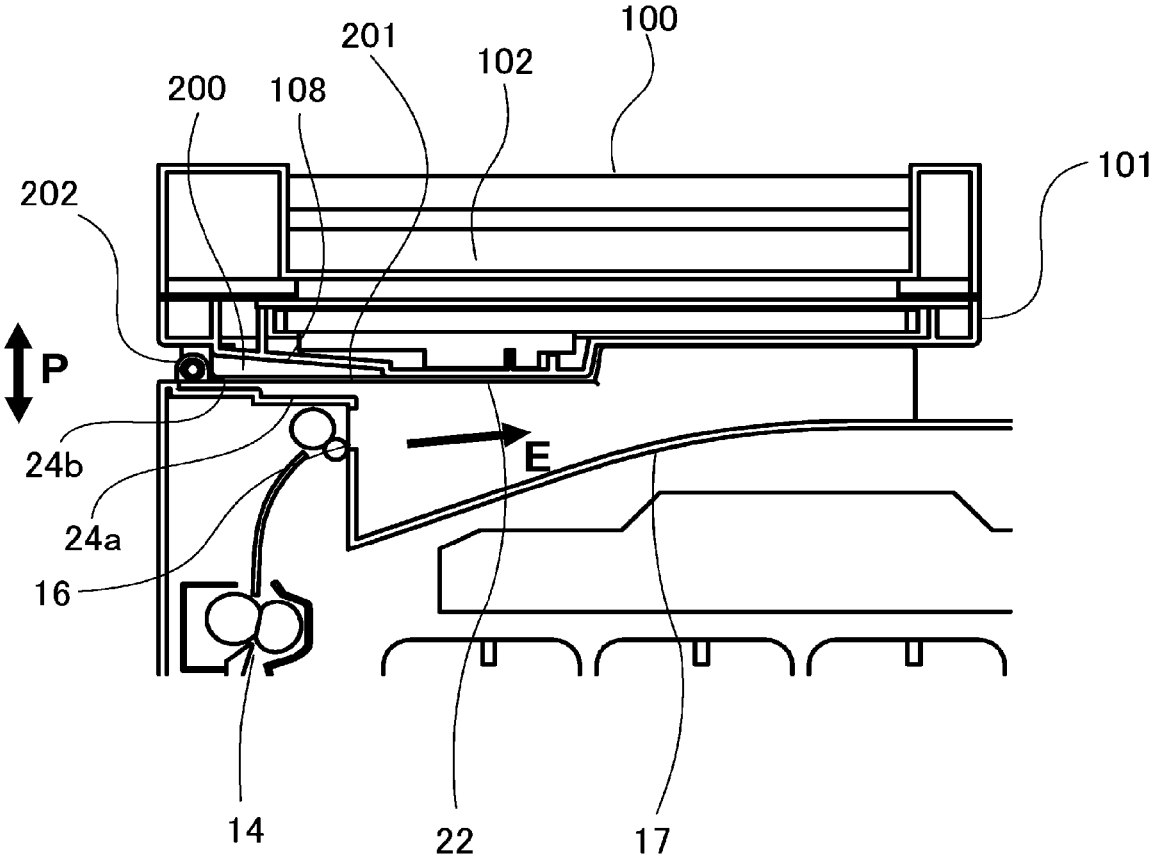
FIG. 11 is a sectional view of a combination of the original reading device and main assembly of the image forming apparatus in the fourth embodiment of the present invention, and shows the positional relationship between the original reading device and main assembly.

Next, the image forming apparatus in the fourth embodiment of the present invention is described with reference to the appended drawings. The components, portions thereof, etc., of the image forming apparatus in this embodiment, which are the same in description as the counterparts in the first to third embodiments, are given the same referential codes as those given to the counterparts, one for one, and are not described here. FIG. 11 is a sectional view of the combination of the apparatus main assembly 10 and original reading device 100 of the image forming apparatus in the fourth embodiment, and shows the positional relationship between the original reading device 100 and apparatus main assembly 10.

Referring to FIG. 11, the image forming apparatus in this embodiment is provided with front-center surfaces 24*a* and 24*b*, which are similar to the front-center surfaces 24*a* and 24*b* in the second embodiment, instead of the slanted surface 24 in the first embodiment. Further, it is provided with a slanted surface 108, which is similar to the slanted surface 108 in the third embodiment, instead of the surfaces similar to the front-center surfaces 108*a* and 108*b* in the first embodiment. The duct 200 is made up of the front-center surfaces 24*a*, rear-center surface 24*b*, slanted surface 108, rear-top surface 22*a*, and rear top surface 22*b*.

The structural arrangement in this embodiment described above can also position the rear opening 202 of the duct 200 higher, in terms of the vertical direction, than the front opening 201 of the duct 200. Therefore, not only is it possible to structure the water vapor discharge passage so that the water vapor is discharged from the front side of the apparatus main assembly 10 (direction indicated by arrow mark A), but also, from the rear side of the apparatus main assembly 10 (direction indicated by arrow mark B). Therefore, it is possible to highly efficiently discharge the water vapor from the space between the apparatus main assembly 10 and original reading device 100 of the image forming apparatus 1000, and therefore, to prevent the water vapor from condensing on the bottom surface of the original reading device 100, without increasing the image forming apparatus 1000 in size, and altering the image forming apparatus 1000 in frontal appearance.

Embodiment 5

Figure 12:
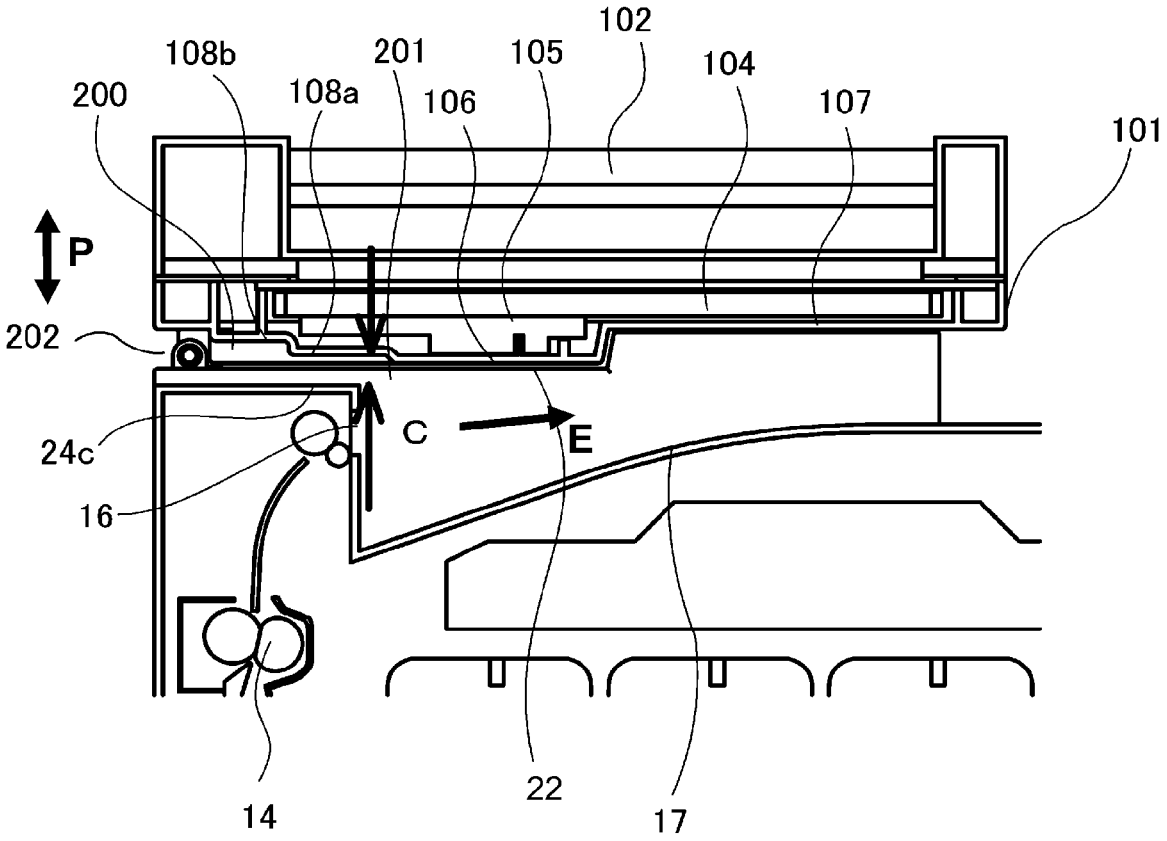
FIG. 12 is a sectional view of a combination of the original reading device and main assembly of the image forming apparatus in the fifth embodiment of the present invention, and shows the positional relationship between the original reading device and main assembly.

Next, the image forming apparatus in the fifth embodiment of the present invention is described with reference to the appended drawings. The components, portions thereof, etc., of the image forming apparatus in this embodiment, which are the same in description as the counterparts in the first to third embodiments, are given the same referential codes as those given to the counterparts, one for one, and are not described here. FIG. 12 is a sectional view of the combination of the original reading device 100 and apparatus main assembly 10 of the image forming apparatus in this embodiment, and shows the positional relationship between the original reading device 100 and apparatus main assembly 10.

Referring to FIG. 12, the image forming apparatus in this embodiment is provided with a horizontal surface 24*c*, unlike the image forming apparatus in the first embodiment, which is provided with slanted surface 24. The duct 200 is made up of the horizontal surface 24*c*, front-center surface 108*a*, rear-center surface 108*b*, rear-top surface 22*a*, and rear-top surface 22*b*.

Figure 13:
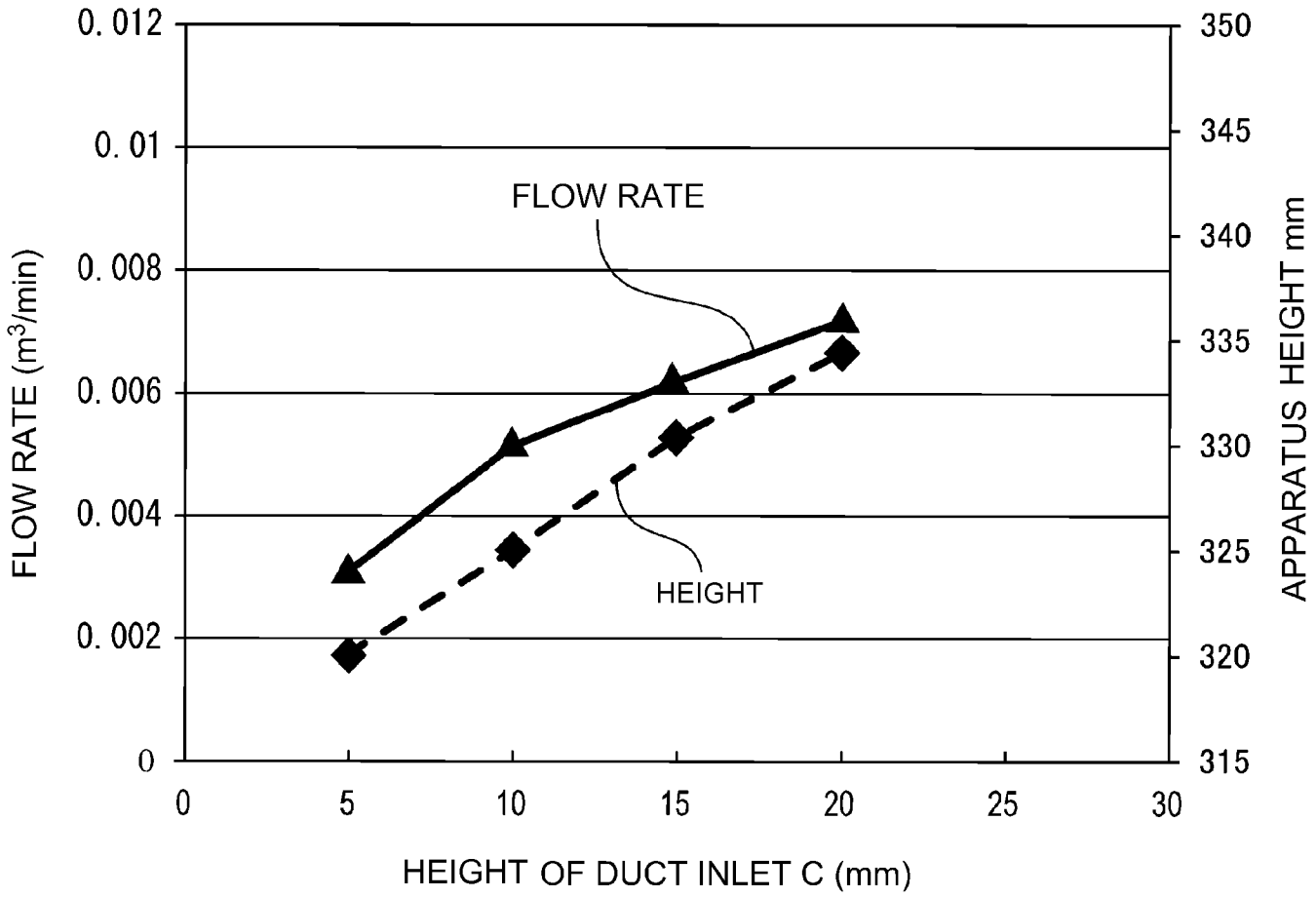
FIG. 13 is a drawing which shows the relationship among the duct entrance height, air flow rate through the duct, calculated with the use of thermal fluid dynamics simulation, and image forming apparatus height, in the fifth embodiment.

FIG. 13 is a drawing which shows the relationship among the duct entrance height C (height of front entrance 201 of duct 200), volume (amount) by which air flows into the duct 200, and which is calculated through thermal fluid dynamics simulation, and product height (height of image forming apparatus 1000). As is evident from FIG. 13, by setting the duct entrance height C to a value in a range of 10-20 mm, it is possible to reduce the apparatus in height, while ensuring that air flows into the duct 200 by a sufficient amount.

The structural arrangement in this embodiment described above can also structure the water vapor discharge passage so that the water vapor is discharged from the front side of the apparatus main assembly 10 (direction indicated by arrow mark A), but also, from the rear side of the apparatus main assembly 10 (direction indicated by arrow mark B). Therefore, it is possible to highly efficiently discharge the water vapor from the space between the apparatus main assembly 10 and original reading device 100 of the image forming apparatus 1000, and therefore, to prevent the water vapor from condensing on the bottom surface of the original reading device 100, without increasing the image forming apparatus 1000 in size, and altering the image forming apparatus 1000 in frontal appearance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 012427/2014 filed Jan. 27, 2014, which is hereby incorporated by reference.

What is claimed is:

1. An image forming apparatus comprising:

an image forming station including a heating portion for heating a sheet and a discharge opening for discharging the sheet, having passed through said heating portion, in a discharging direction;

an image reading station provided above said image forming station to read image information of an original; and a duct portion provided by an upper surface of said image forming station and a lower surface of said image reading station, and at a position upstream of said discharge opening with respect to the discharging direction, wherein a portion of said lower surface of said image reading station as provides said duct portion includes an inclined surface having a level higher toward an upstream side with respect to the discharging direction.

2. An apparatus according to claim 1, wherein a portion of said upper surface of said image forming station as provides said duct portion is at a level higher toward the upstream side with respect to the discharging direction.

3. An apparatus according to claim 2, wherein the portion of said upper surface of said image forming station as provides said duct portion includes a first surface and a second surface, which is upstream of said first surface with respect to the discharging direction, wherein said second surface is at a level higher than that of said first surface.

4. An apparatus according to claim 2, wherein the portion of said upper surface of said image forming station as provides said duct portion includes an inclined surface having a level higher toward the upstream side with respect to the discharging direction.

5. An apparatus according to claim 1, wherein the portion of said upper surface of said image forming station as provides said duct portion is a horizontal surface.

6. An apparatus according to claim 1, further comprising a sheet stacking surface provided downstream of said discharge opening with respect to the sheet discharging direction to stack sheets discharged through said discharge opening.

7. An apparatus according to claim 1, wherein said heating portion functions as a fixing portion for fixing a toner image.

8. An image forming apparatus comprising:

an image forming station including a heating portion for heating a sheet and a discharge opening for discharging the sheet, having passed through said heating portion, in a discharging direction;

an image reading station provided above said image forming station to read image information of an original; and a duct portion provided by an upper surface of said image forming station and a lower surface of said image reading station, and at a position upstream of said discharge opening with respect to the discharging direction, wherein a portion of said lower surface of said image reading station as provides said duct portion includes a first surface and a second surface which is upstream of said first surface with respect to the discharging direction, wherein said second surface is at a level higher than that of said first surface.

9. An image forming apparatus comprising:

an image forming station including a heating portion for heating a sheet and a sheet stacking portion for stacking the sheet discharged through said heating portion in a discharging direction, said sheet stacking portion being provided in an upper portion of said image forming apparatus;

an image reading station provided above said image forming station to read image information of an original; and a duct portion provided by an upper surface of said image forming station and a lower surface of said image reading station, and at a position upstream of said stacking portion with respect to the discharging direction, wherein a portion of said lower surface of said image reading station as provides said duct portion includes an inclined surface having a level higher toward an upstream side with respect to the discharging direction.

10. An apparatus according to claim 9, wherein a portion of said upper surface of said image forming station as provides said duct portion is at a level higher toward an upstream side with respect to the discharging direction.

11. An apparatus according to claim 10, wherein the portion of said upper surface of said image forming station as provides said duct portion includes a first surface and a second surface,. which is upstream of said first surface with respect to the discharging direction, wherein said second surface is at a level higher than that of said first surface.

12. An apparatus according to claim 10, wherein the portion of said upper surface of said image forming station as provides said duct portion includes an inclined surface having a level higher toward the upstream side with respect to the discharging direction.

13. An apparatus according to claim 9, wherein the portion of said upper surface of said image forming station as provides said duct portion is a horizontal surface.

14. An apparatus according to claim 9, wherein said heating portion functions as a fixing portion for fixing a toner image.

15. An image forming apparatus, comprising:

an image forming station including a heating portion for heating a sheet and a sheet stacking portion for stacking the sheet discharged through said heating portion in a discharging direction, said sheet stacking portion being provided in an upper portion of said image forming apparatus;

an image reading station provided above said image forming station to read image information of an original; and a duct portion provided by an upper surface of said image forming station and a lower surface of said image reading station, and at a position upstream of said stacking portion with respect to the discharging direction, wherein a portion of said lower surface of said image reading station as provides said duct portion is at a level higher toward an upstream side with respect to the discharging direction; and wherein a portion of said lower surface of said image reading station as provides said duct portion includes a first surface and a second surface which is upstream of said first surface with respect to the discharging direction, wherein said second surface is at a level higher than that of said first surface.

* * * * *